US005447663A

United States Patent [19]

Dix et al.

[11] Patent Number: 5,447,663

[45] Date of Patent: Sep. 5, 1995

[54] FLOOR MOUNTED HUMIDIFIER WITH WHEELED WATER RESERVOIR TANK

[75] Inventors: Gregory F. Dix, Florissant; Mark J. Tomasiak, O'Fallon, both of Mo.

[73] Assignee: Emerson Electric Co., St. Louis, Mo.

[21] Appl. No.: 213,000

[22] Filed: Mar. 15, 1994

[51] Int. Cl.[6] ..... B01F 3/04

[52] U.S. Cl. ..... 261/70; 261/72.1; 261/104; 261/142

[58] Field of Search ..... 261/70, 72.1, 104, 142

[56] References Cited

U.S. PATENT DOCUMENTS

| | | | |
|---|---|---|---|
| 3,306,010 | 2/1967 | Garfalow et al. | 261/70 |
| 3,338,262 | 8/1967 | Chopelin | 261/70 |
| 3,914,349 | 10/1975 | Stipanuk | 261/29 |
| 4,060,576 | 11/1977 | Grant | 261/70 |
| 4,117,045 | 9/1978 | Henke et al. | 261/30 |
| 4,237,080 | 12/1980 | Elliott | 261/80 |
| 4,252,547 | 2/1981 | Johnson | 261/72.1 |
| 4,276,241 | 6/1981 | Stewart et al. | 261/92 |
| 4,640,521 | 2/1987 | Berfield | 280/47 |
| 4,822,533 | 4/1989 | Steiner et al. | 261/72.1 |
| 4,865,775 | 9/1989 | Steiner et al. | 261/24 |
| 4,970,876 | 11/1990 | Vinokurov | 261/107 |
| 5,061,405 | 10/1991 | Stanek et al. | 261/26 |
| 5,162,088 | 11/1992 | Peng et al. | 261/72.1 |
| 5,250,232 | 10/1993 | Pepper et al. | 261/107 |

FOREIGN PATENT DOCUMENTS

| | | | |
|---|---|---|---|
| 3409196 | 9/1985 | Germany | 261/72.1 |

*Primary Examiner*—Tim R. Miles

*Attorney, Agent, or Firm*—Polster, Lieder, Woodruff & Lucchesi

[57] ABSTRACT

An improved floor mounted humidifier is disclosed. The humidifier draws dry air into and discharges humidified air from the humidifier. In order to facilitate the refilling of the humidifier with water, a wheel mounted water reservoir tank is provided. The water reservoir tank provides floor movement to a water source to enable the refilling of the water reservoir tank and for return to the floor mounted humidifier. The water reservoir tank also includes a handle for controlled movement of the water reservoir tank. The handle is capable of being extended during wheeled movement of the water reservoir tank and retracted when subsequently re-positioned relative to the humidifier. The water reservoir tank is incorporated into the floor mounted humidifier as an integrated component without detracting from the overall appearance of the humidifier.

17 Claims, 7 Drawing Sheets

FLOOR MOUNTED HUMIDIFIER WITH WHEELED WATER RESERVOIR TANK

BACKGROUND OF THE INVENTION

The present invention is directed to a floor mounted portable humidifier, and more specifically to a new and improved water reservoir tank for association with the floor mounted humidifier that provides a safe, efficient and reliable method for refilling the humidifier.

Console or floor mounted humidifiers are typically designed with substantial water capacity in order to discharge sufficient quantities of humidified air over a predetermined time period. As a result, console or floor mounted humidifiers are generally not removable from a predetermined location in a particular room setting, although such humidifiers are mounted on casters for moving the entire humidifier to a water source for filling, if desired. Other than the cumbersome task of moving the entire humidifier, the typical methods used in refilling such humidifiers is to carry water in buckets or containers which are deposited in a humidifier water compartment or the use of refillable water containers which are detachably mounted to the humidifiers for refilling purposes. Several examples of humidifiers that are mounted on casters as well as include a refillable water compartment are shown in U.S. Pat. Nos. 4,822,533 and 4,865,775. One example of a humidifier with a refillable container is shown in U.S. Pat. No. 5,061,405.

The prior art, as represented by the above and other patents dealing with water refilling of console or floor mounted humidifiers, are thus primarily of three types: those which are mounted on casters for movement of the entire humidifier, those which include a refillable water compartment requiring the carrying of separate containers or buckets of water to refill the compartment or those which include a detachably mounted refillable container that can be carried to a water source for refilling and then returned to the humidifier. It will be appreciated that some console humidifier designs include casters for moving the entire humidifier as well as a refillable water compartment, thus giving the user an option to use either of such refilling techniques. Rolling the entire humidifier to a water source is burdensome and in many cases, unpractical. At the same time, it is time consuming and inefficient to make repeated trips to a water source for refilling a humidifier that incorporates a water refillable compartment. Where detachable refillable containers are used in console or floor mounted humidifiers, it will also be appreciated that the detachable refillable containers have a size limit due to the weight of the refillable containers when filled with water.

There has thus been a long felt need for a new and improved water filling technique/construction that overcomes the aforementioned problems of the prior art through a more efficient and practical way of refilling console or floor mounted humidifiers. As will be appreciated in the discussion that follows, the new and improved water refilling technique/construction of the present invention provides other improved features and advantages, including a safe, reliable and efficient water refilling technique.

SUMMARY OF THE INVENTION

Among the several objects and advantages of the present invention include:

The provision of a new and improved floor mounted humidifier that overcomes the aforenoted problems of the prior art;

The provision of the aforementioned new and improved floor mounted humidifier which includes a new and improved water refilling system/construction;

The provision of the aforementioned new and improved water refillable system/construction in a floor mounted humidifier which is safe, reliable and efficient as compared to prior art techniques;

The provision of the aforementioned new and improved water refillable system/construction in a floor mounted humidifier which provides wheeled movement of a water reservoir tank to a water source to fill the water reservoir tank and return to the floor mounted humidifier;

The provision of the aforementioned new and improved water refillable system/construction in a floor mounted humidifier which further includes a handle to facilitate controlled wheeled movement of the water reservoir tank.

The provision of the aforementioned new and improved water refillable system/construction in a floor mounted humidifier which is constructed to be a part of the humidifier without detracting from the appearance thereof;

The provision of the aforementioned new and improved water refillable system/construction in a floor mounted humidifier which includes a unique overflow valve mechanism;

The provision of the aforementioned new and improved water refillable system/construction in a floor mounted humidifier which is easy to operate and maintain; is durable in construction and use; is simplified in construction and made of up of a minimum number of parts; is easily incorporated into a floor mounted humidifier without affecting the operation or detracting from the appearance of the humidifier; and is otherwise well adapted for the purposes intended.

Briefly stated, the floor mounted humidifier of the present invention includes humidifying means for drawing dry air into and for discharging humidified air from the humidifier, in which the improvement of the present invention includes a wheel mounted water reservoir tank for floor movement to a water source to fill the water reservoir tank and for return to the floor mounted humidifier. The water reservoir tank includes a handle to facilitate controlled wheeled movement of the water reservoir tank in the aforementioned manner. The handle is preferably a retractable handle that is extended in order to facilitate wheeled movement of the water reservoir tank to a water source for filling of the water reservoir tank and for return to the floor mounted humidifier where the handle is retracted. The handle is preferably of the telescoping type that extends for movement of the water reservoir tank as described above and then collapses in an out-of-the-way position when returned to the humidifier.

The telescoping handle is a U-shaped handle having opposed handle side legs interconnected to a handle end leg. The opposing handle side legs are mounted over opposite end surfaces of the water reservoir tank to present the handle end leg in a generally horizontal position for gripping by a user. In one embodiment of the present invention, the opposing handle side legs of the U-shaped handle are mounted in angularly offset guide elements that are attached or otherwise secured to opposite end surfaces of the water reservoir tank to present the opposing handle side legs and handle end leg of the U-shaped handle at an angle to a top surface of the water reservoir tank, when the U-shaped handle is extended. The U-shaped handle angle and its height are optimized relative to the shape of the water reservoir tank in order to balance water weight over the wheels of the water reservoir tank when being moved.

In the embodiment that includes the angularly offset guide elements, such guide elements include guide portions that extend below the water reservoir tank to serve as legs in supporting the water reservoir tank in an upright condition in conjunction with the wheels. The guide portions that extend below the water reservoir tank are also cooperatively received within complementary recesses of the humidifier for detachably mounting the water reservoir tank to the humidifier. Preferably, the complementary recesses of the humidifier are formed in a supporting base that is also constructed to receive water for use with a wicking element in the humidifying system.

In another embodiment of the present invention, a decorative molded cover element extends over each end of the water reservoir tank and includes an integral foot element that serves as one of two spaced supporting legs for use in conjunction with the wheels for supporting the water reservoir tank in an upright condition when separated from the supporting base. The integral foot elements are also capable of being interengaged within complementary shaped recesses provided in the supporting base for detachably mounting the water reservoir tank to the supporting base.

The aforementioned modified decorative molded cover element may also be provided with an integral U-shaped channel on the inside thereof for receiving spaced and opposed handle side legs of the U-shaped handle in slidable mounted relationship to provide the extendable/retractable feature for the U-shaped handle, in lieu of using tube guide elements.

The humidifying system is preferably contained in a fixed compartment that is mounted to the supporting base while the water reservoir tank is part of a detachable compartment of the humidifier. The detachable compartment including water reservoir tank are detachably mounted to the supporting base in proximity to the fixed compartment.

The humidifier includes a hinged cover for overlying the detachable compartment or water reservoir tank when detachably mounted to the supporting base. Preferably, the hinge cover is mounted to the fixed compartment. Also, a valve is mounted to a lower end surface of the water reservoir tank for selectively dispensing water from the water reservoir tank to the humidifying system through the supporting base.

A connecting hose with hose fitting is also mounted with respect to the water reservoir tank, the connecting hose being contained within the water reservoir tank until use is desired. An enlarged recess is also provided in the top of the water reservoir tank for filling by a separate container, if desired.

An overflow valve mechanism for use with the water reservoir tank is also contemplated. This overflow valve mechanism works in conjunction with a water dispensing valve at the lower end of the water reservoir tank and operates to shut off the water dispensing valve when the water level rises beyond a predetermined level. Below the predetermined level, the overflow valve is suspended in a neutral position allowing the water dispensing valve to selectively dispense water to the predetermined level. The overflow valve will suspend the operation of the water dispensing valve should an excess of water be dispensed.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way of limitation. This description will clearly enable one skilled in the art to make and use the invention, and describes several embodiments, adaptions, variations, alternatives and uses of the floor mounted humidifier with wheeled water reservoir tank as disclosed, including what we presently believe is the best mode of carrying out the invention.

Figure 5:
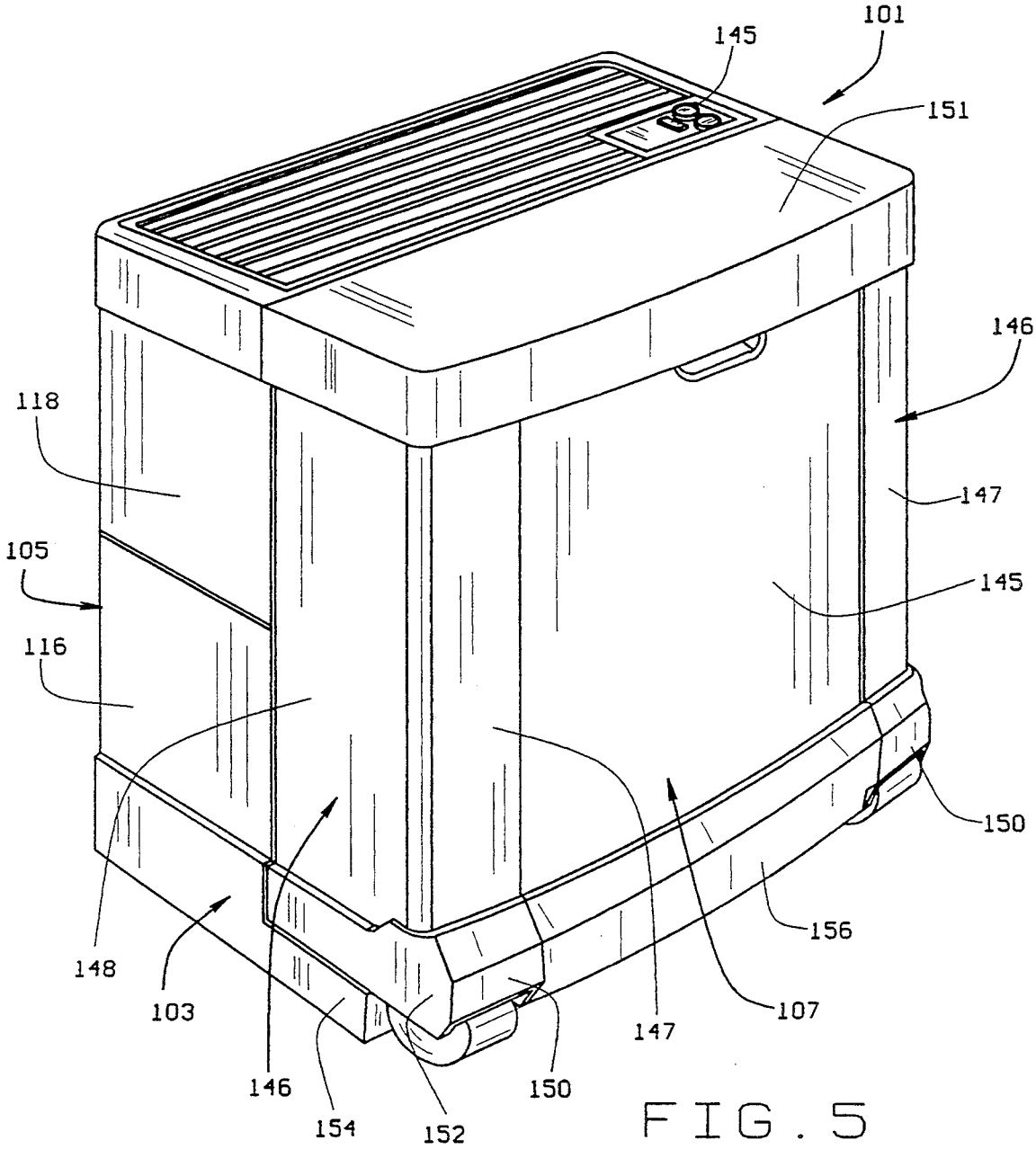
FIG. 5 is a perspective view of an alternative preferred embodiment of the floor mounted humidifier of the present invention.
Figure 6:
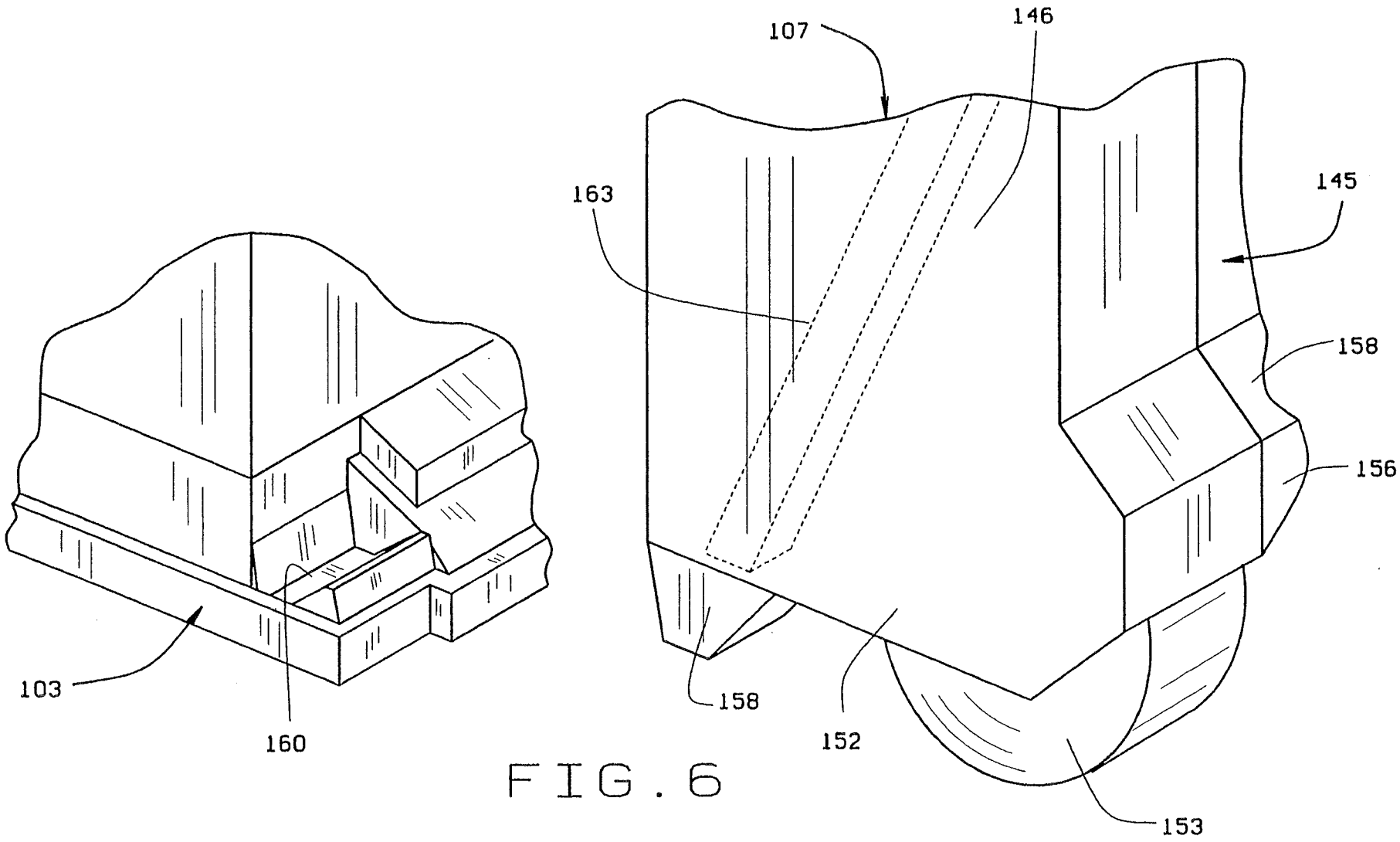
FIG. 6 is an exploded fragmentary perspective view of the modified humidifier shown in FIG. 5 including water reservoir tank and associated supporting base which particularly highlights the shape and construction of an integral foot element associated with the water reservoir tank and its cooperataive mating with a humidifier supporting base.
Figure 7:
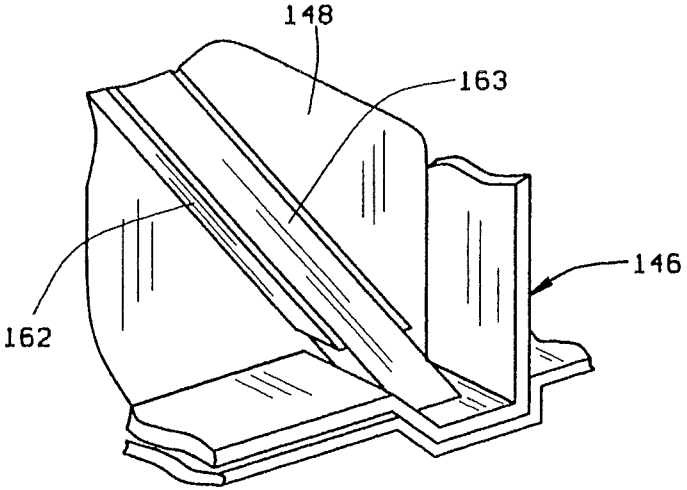
FIG. 7 is a fragmentary inside perspective view illustrating the floor mounted humidifier of FIG. 5 with its modified decorative molded cover element including an integral handle support and integral foot element.
Figure 8:
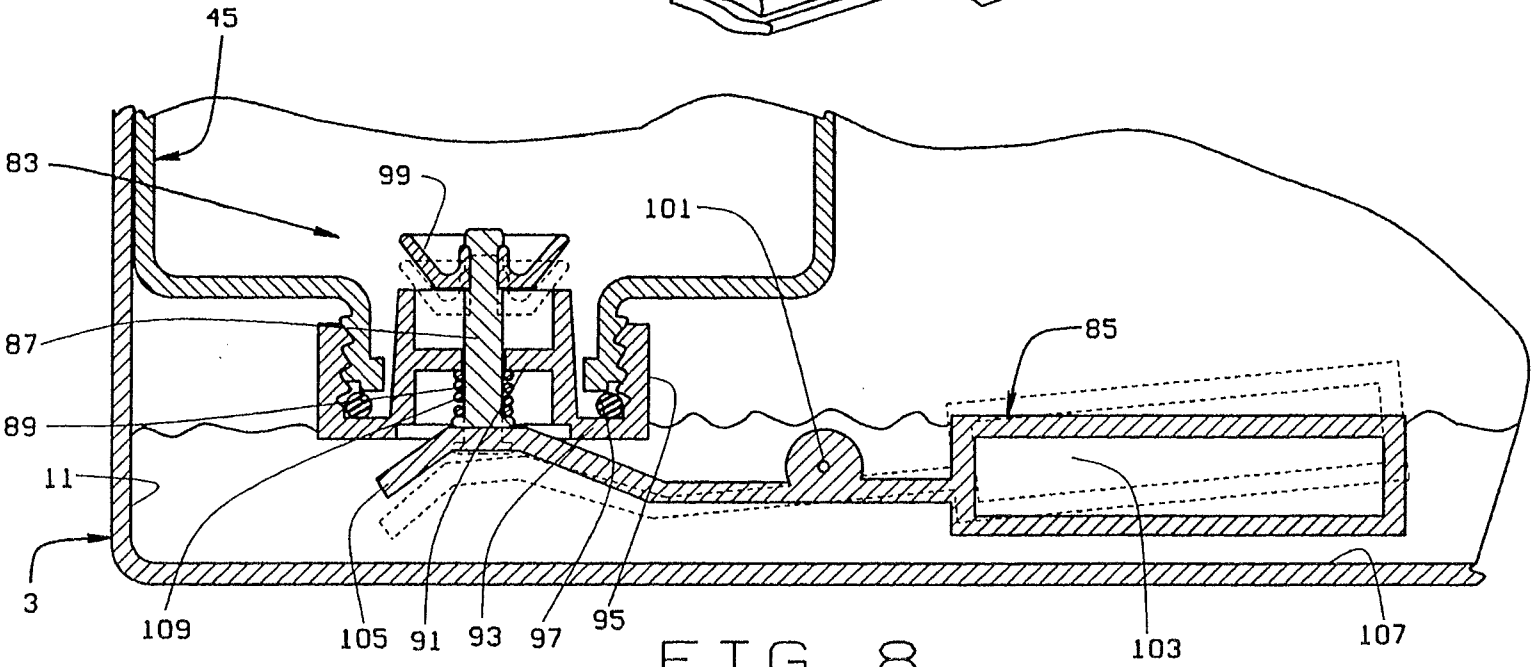
FIG. 8 is a fragmentary sectional view of the water reservoir tank used in either of the humidifier embodiments and illustrating the operation of the overflow valve mechanism.

One embodiment of the present invention showing a floor mounted humidifier with upwardly retractable wheel cover to expose a water reservoir tank foot rest is illustrated in FIGS. 1–4 of the drawings. An alternate and preferred embodiment of the invention with a built-in foot rest at the lower end of the water reservoir tank is shown in FIGS. 5–7. FIG. 8 illustrates an overflow valve mechanism which can be used with the water reservoir tank of either disclosed embodiment.

Referring first to the floor mounted humidifier with wheeled water reservoir tank 1 illustrated in FIGS. 1–4, it will be seen that the floor mounted humidifier 1 includes a supporting base 3, a fixed compartment 5 mounted on the supporting base 3 which incorporates the humidifying system presently to be described, and the wheeled water reservoir tank 7 which is part of a detachable compartment that is adjacently positioned relative to the fixed compartment 5 and mounted relative to the supporting base 3, as will become apparent.

Figure 1:
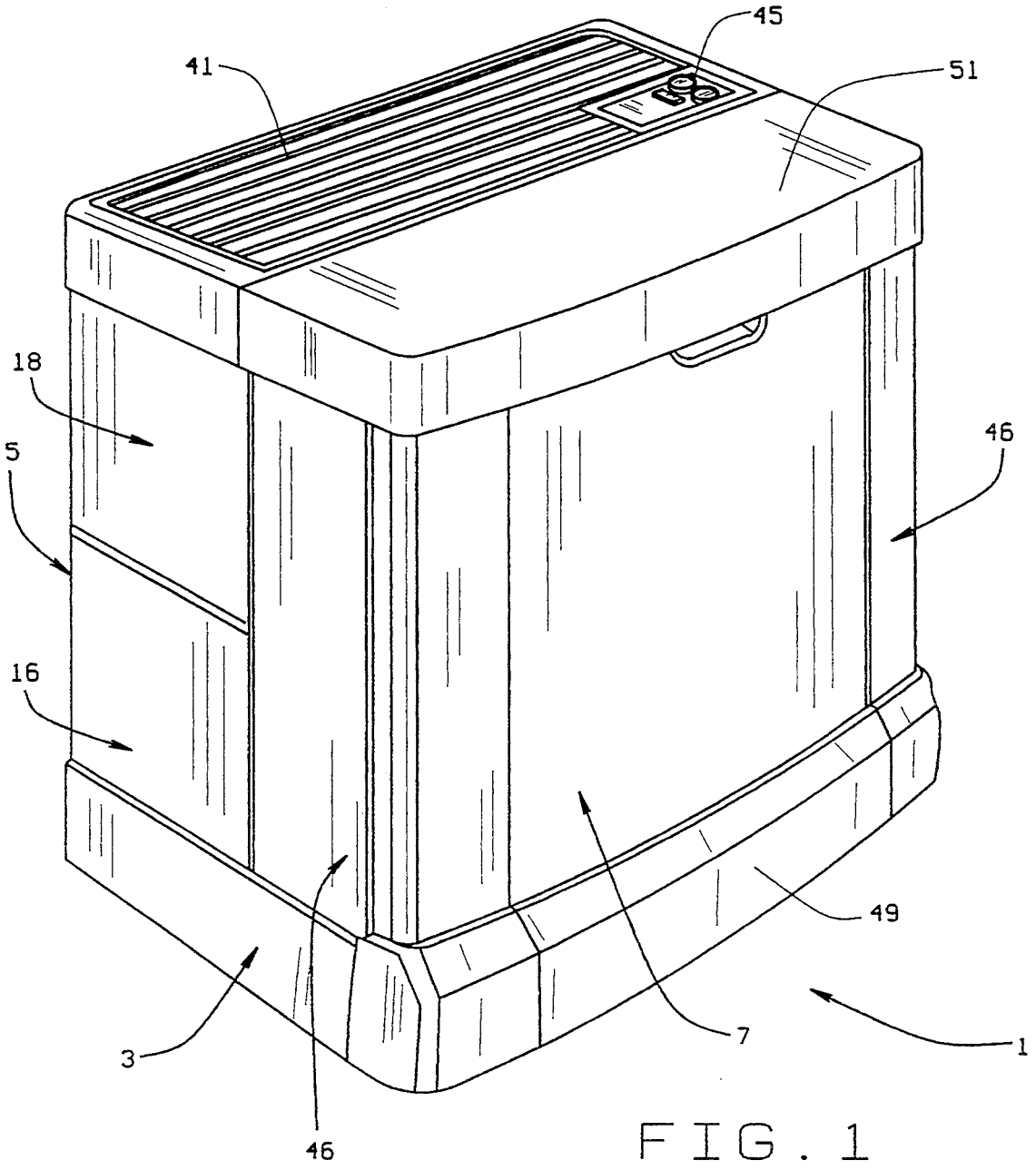
FIG. 1 is a perspective view of the floor mounted humidifier with the new and improved water refillable system/construction in the form of a wheeled water reservoir tank that incorporates the features of the present invention.
Figure 2:
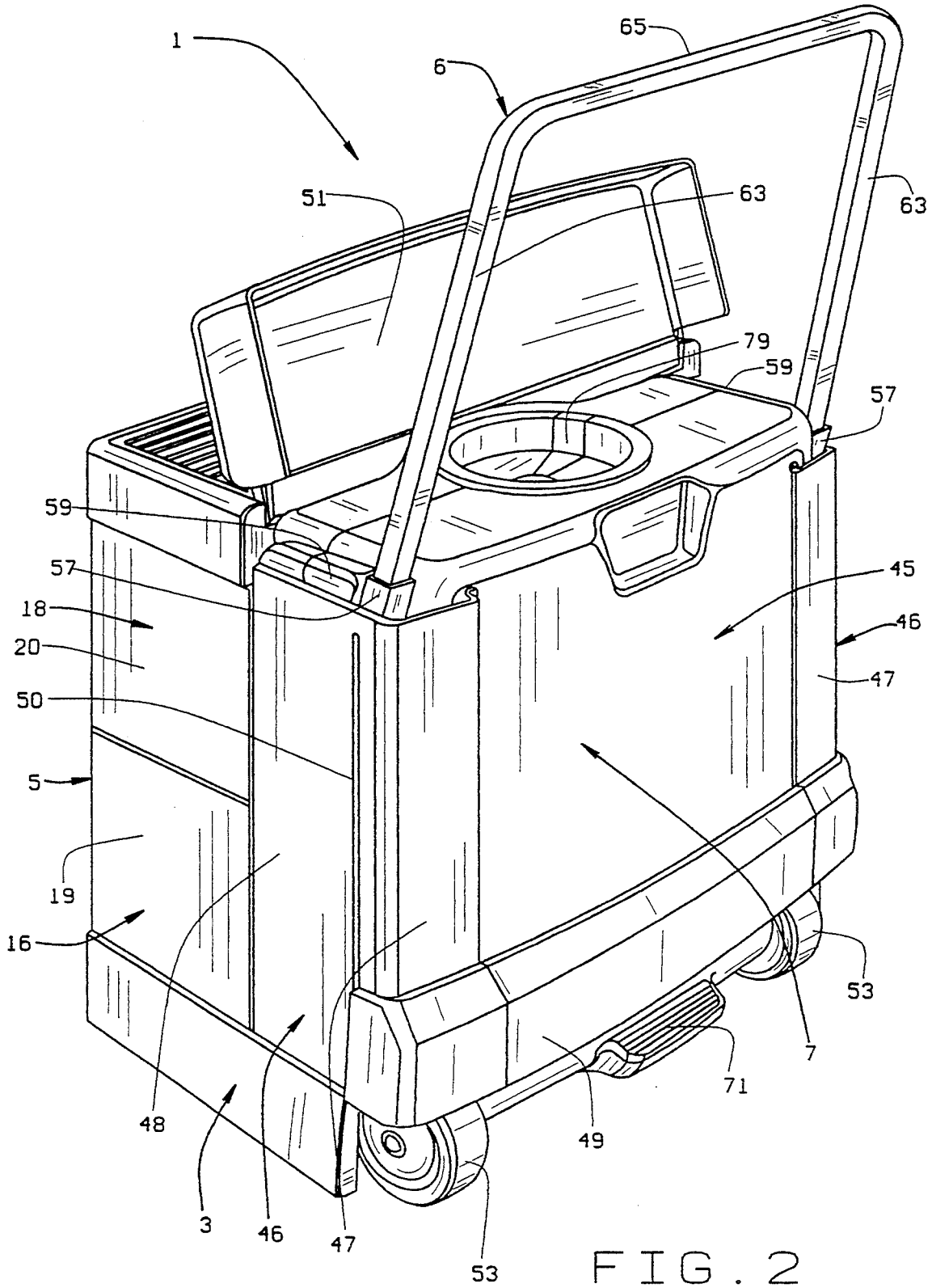
FIG. 2 is a perspective view illustrating the use of an extensible handle in the new and improved water refillable system/construction of the present invention.
Figure 4:
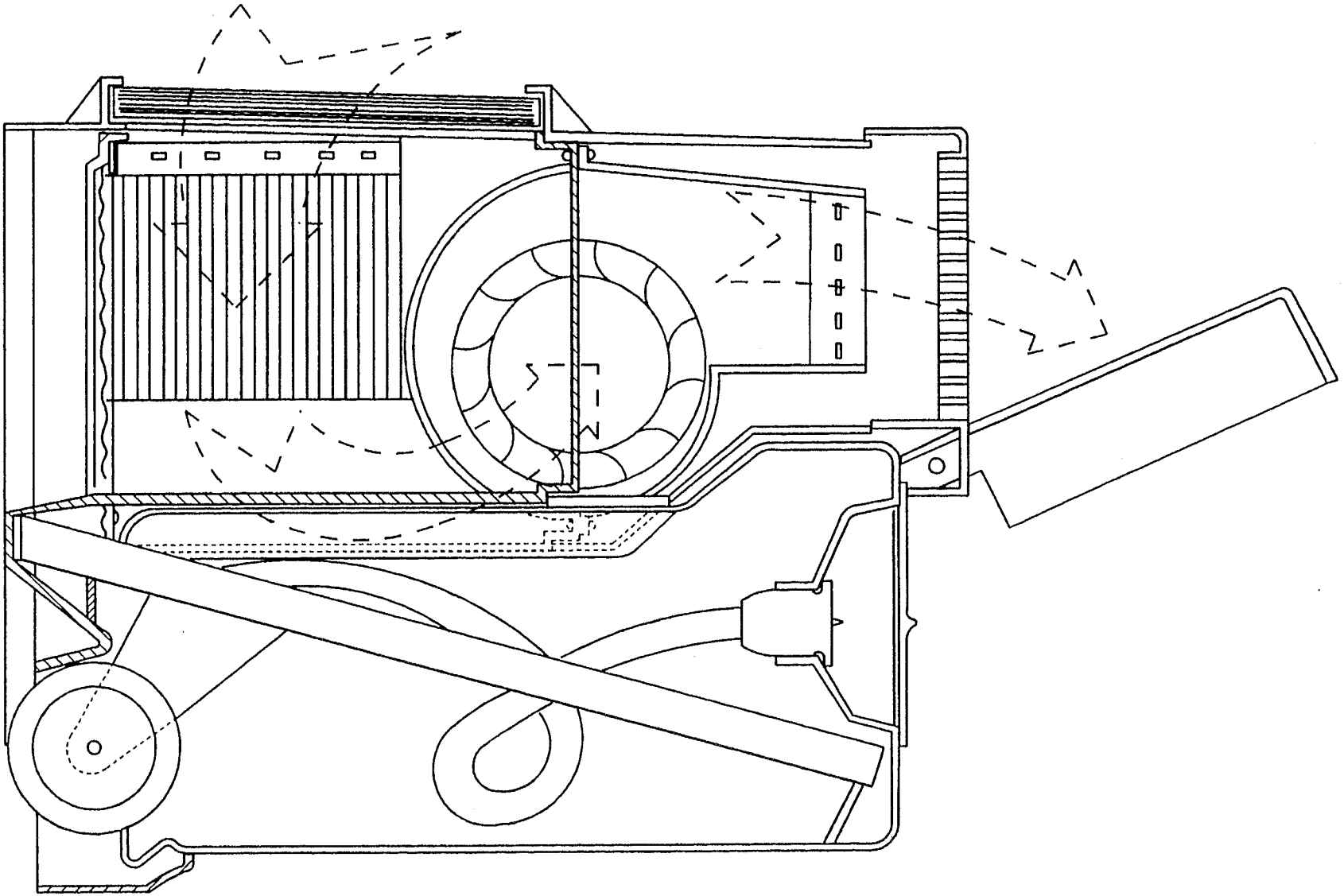
FIG. 4 is a sectional view of the floor mounted humidifier illustrating the humidifying system and the wheeled reservoir tank that incorporates the features of the present invention.

For the construction of the supporting base 3, it will be seen from FIGS. 1–2 and 4 of the drawings that the supporting base 3 is an injection molded rectangular shaped component having an integral peripheral support 9 surrounding the supporting base 3, also having a generally rectangular shaped construction. The supporting base 3 further includes a water catch basin 11 formed internally of the peripheral wall support 9 for receiving water from the water reservoir tank 7 and for transferring same to the humidifying system, described further below. On opposite ends of the supporting base 3, a pair of spaced U-shaped recesses/openings 13 are provided for receiving tube guide portions of the water reservoir tank, also described in further detail below. For cooperation with the fixed compartment 5, the peripheral wall structure 9 includes an inwardly offset shoulder 15 for receiving lower exterior surfaces 17 of the fixed compartment 5 in stacked, interconnected relationship, as illustrated in FIG. 4 of the drawings.

While the fixed base 5 is designed to remain non-movable relative to the supporting base 3 during the humidifying operation, the fixed base 5 is also designed to be removed from the supporting base 3 for cleaning and replacement of parts.

In this respect, the fixed compartment 5 of the floor mounted humidifier 1 is constructed as lower and upper upstanding and stacked rectangularly shaped injection molded components 16, 18, respectively. The lower and upper molded components 16, 18 are constructed to be separated from one another for cleaning and replacement purposes. The lower molded component 16 has spaced end walls 19, 19 and front and rear side walls 21, 23, respectively. The upper stacked molded component 18 has spaced end walls 20, 20, which are aligned with corresponding spaced end walls 19, 19 on the lower molded component 16, and front and rear side walls 22, 24, respectively, which are aligned with the front and rear side walls 21, 23 of the lower molded component 16. Both of the spaced end walls 19, 19 and the rear side wall 23 of the lower molded component 16 include a peripheral foot or shelf 17 for complementary reception by the inwardly offset shoulder 15 of the supporting base 3, in order to vertically support the stacked lower and upper molded components 16, 18 of the fixed compartment 5 in the upright position illustrated in FIGS. 1–4 of the drawings. The lower molded component 16 not only supports the upper molded component 18 in stacked relationship, but also includes the lower half of the scroll housing 26 which cooperates with the upper half of the scroll housing 28 in partially surrounding the blower 37 and in forming the blower passageway 39, to be further described below.

The humidifying system within the fixed compartment 5 includes a wicking element 25 that is preferably constructed from a suitable sheet-like absorbent and capillary wick material, as described in detail in U.S. Pat. No. 4,822,533. As disclosed in that patent, a unitary web of non-woven, fibrous and absorbent wicking media maintains its shape and physical properties when in contact with water for extended periods of time. Such material is preferable since it has sufficient absorption and capacity as well as sufficient capillary action such that with only the bottom of the wick element 25 submerged below a predetermined level of water within the catch basin 11, the wick element 25 will absorb water and will wick the water vertically by capillary action along the entire height of the wicking element 25. In this manner, the wicking element 25 is substantially uniformly wetted throughout. Typically, the wick element 25 begins to soak up water immediately and becomes totally saturated in a short period of time, approximately thirty minutes.

An electric heater 27 may be mounted, if desired, along one side of the wick element 25 adjacent the rear wall 23 of the fixed compartment 5. The electric heater 27 is located intermediate the wick element 25 and a filter 29 which is mounted between an upper and lower filter supports 31, 33 projecting outwardly from the rear wall 23 of the fixed compartment 5. The filter 29 extends across an opening 35 in the rear wall 23 of the fixed compartment 5, the opening 35 corresponding in height and width to the wick element 25, as best seen in FIG. 4 of the drawings. Alternatively, where the heater 27 is mounted at an upper location presently to be described, the wick element 25 can be easily removed and replaced by simply removing the filter 29 or a corresponding air entry grill (not shown), as will be understood.

Outside air O, represented by the arrow entering the filter 29 and into the wick element 25, is first filtered by the filter element 29 prior to entry into the wick element 25.

The outside air O, after it passes through the wick element 25, will increase the moisture content of the air, as represented by the arrow H exiting from the wick element 25. The humidifier air H is also shown as being drawn into a blower 37 and the blower passageway 39 for exit through the discharge grill openings 41 at the top of the fixed compartment 5. The blower 37, which may comprise twin blowers or a single blower, is driven by a motor (not shown), in order to establish an air flow path as represented by the arrows H from the wick element 25, past the blower 37 and into the blower passageway 39, for discharge through the exhaust openings 41, as best illustrated in FIG. 4 of the drawings.

At the top of the blower passageway 39, a phantom illustration of an alternate heater location 43 is illustrated. Thus, an electric heater may be installed at either location shown in full lines represented by the numeral 27 at the lower entry area of the outside air O or near the humidified air H exhaust, as represented by the phantom lines 43 in the upper part of the blower passageway 39 or at some other preferred location, as may be desired. When mounted at the lower location, the heater 27 will heat the air prior to the humidifying process, thus enabling the air to be humidified to a greater extent because it is first heated. When mounted at the upper location 43, the exhaust humidified air temperature can be raised from a typical normal 65° to a 90°–100° exhaust heat temperature, in order to prevent cool drafts while providing a supplementary heating source together with the humidified air.

A control panel 45 is mounted in the fixed compartment 5 in the area of the discharge grill openings 41 as shown in FIGS. 1 and 4 of the drawings. The humidifying system, functioning within the fixed compartment 5, operates in a manner similar to prior art constant wicking evaporative humidifier methods of the aforementioned patents, except that the particular construction shown in FIGS. 1–4 is specifically different.

As distinct from prior art methods and constructions, the floor mounted humidifier 1 includes a detachable compartment 7 including a water reservoir tank 45 which is detachably mounted relative to the supporting base 3 and fixed compartment 5, as illustrated in FIGS. 1–4 of the drawings. The water reservoir tank 45 is preferably of a blown molded plastic construction having the shape and appearance as illustrated in the drawings, although other constructions are, of course, possible.

Figure 3:
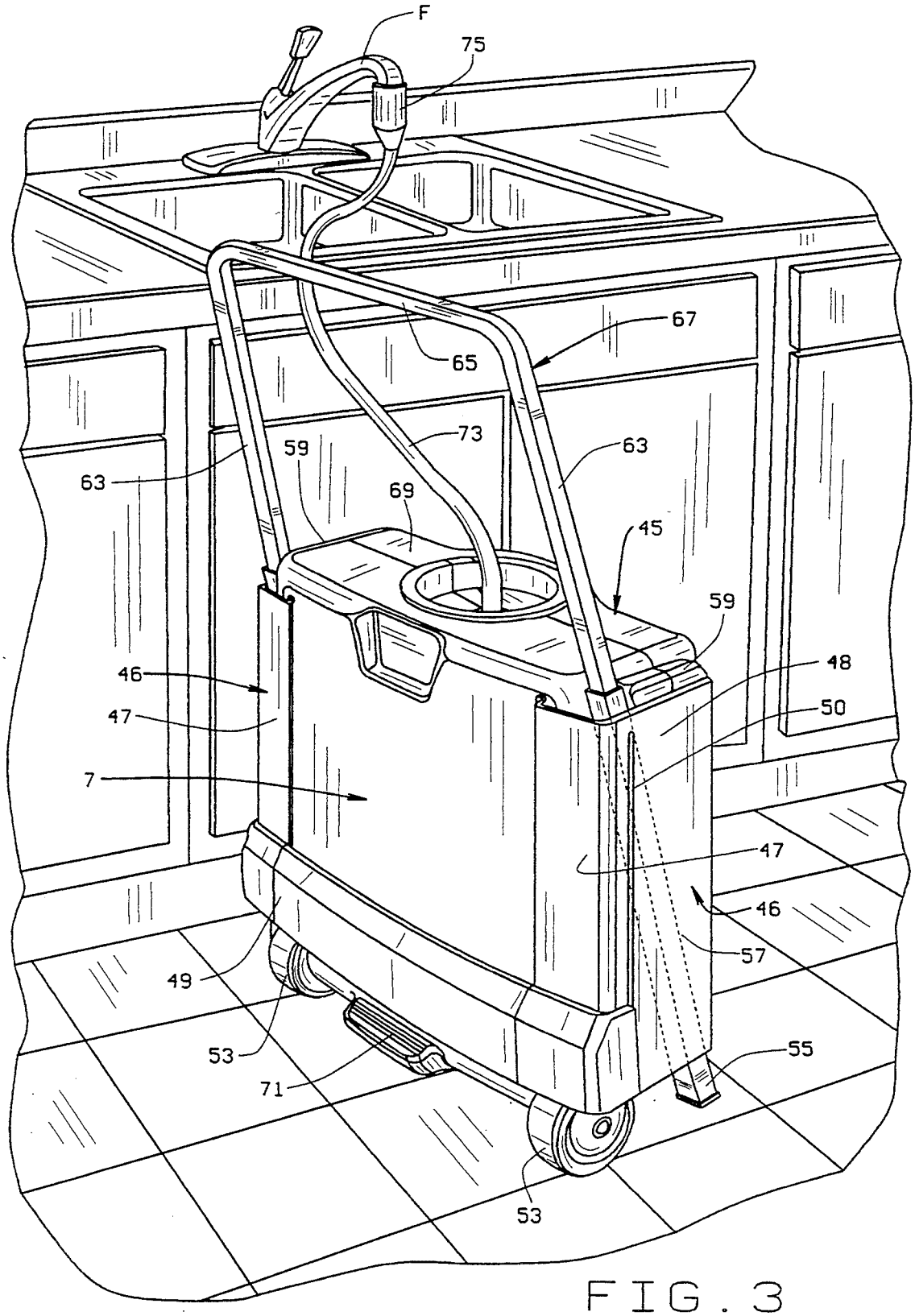
FIG. 3 is a perspective view illustrating the positioning of the wheeled water reservoir tank in proximity to a water source for refilling same.

Since the water reservoir tank 5 is mounted at the front of the floor mounted humidifier 1, decorative molded cover elements 46, 46 include integral decorative front side moldings 47, 47 which are also integrally connected to decorative end moldings 48, 48 to cover part of the front and end surfaces of the water reservoir tank 45. This provides a decorative look and appearance that blends in with the overall look of the floor mounted humidifier 1. A bottom edge or wheel cover molding 49 is mounted across the lower front portions of the water reservoir tank 45 and is constructed to slide along the elongated slots 50, 50 in the decorative end moldings 48, 48 from the lowermost position shown in FIGS. 1 and 4 to a raised position, as shown in FIG. 2–3, for exposing a foot rest 71, for reasons to be subsequently described. To assist in the overall decorative look, a hinged cover 51 may be mounted to the fixed compartment 5 as illustrated in FIG. 4 of the drawings for overlying an upper end of the water reservoir tank 45 to cover the operating functional components of the water reservoir tank 45, presently to be described. The hinged cover 51 thus cooperates with the decorative molded cover elements 46, 46 which include integral front side moldings 47, 47 and integral end moldings 48, 48 which, together with the lower front molding 49, provides a decorative look and appearance to the humidifier along the front and top area thereof, as best illustrated in FIG. 1 of the drawings.

The water reservoir tank 45, generally constructed in an upright rectangular box-shaped configuration, is supported in the upright position illustrated in the drawings by the spaced pair of wheels 53, 53 that extend below the bottom edge or wheel cover molding 49, along one lower surface of the water reservoir tank 45. At an opposite end of such lower surface of the water reservoir tank 45, there are spaced legs 55, 55 which are constructed to extend at an angle outwardly relative to the lower surface of the water reservoir tank 45, in order to support, in conjunction with the spaced wheels 53, 53, the water reservoir tank 45 in an upright position as illustrated.

Preferably, the legs 55, 55 are part of tube guide portions 57, 57 that are mounted to opposite end surfaces 59, 59 of the water reservoir tank 45 by any suitable means or by being captured within the decorative end moldings 48, 48 of the decorative molded cover elements 46, 46, as best illustrated in FIGS. 2–3 of the drawings. Each of the tube guides 57, 57 receive the spaced and opposing handle side legs 63, 63 that are interconnected to a handle end leg 65 in forming the U-shaped retractable or telescoping handle 67. The opposing spaced handle side legs 63, 63 are constructed to be telescopically mounted within the tube guides 57, 57 when the U-shaped handle is fully retracted in its non-operative position, in order to allow the hinged cover 51 to overlie the upper end 69 of the water reservoir tank 45.

The U-shaped retracting/telescoping handle 67 is also constructed to extend to the position illustrated in FIGS. 2–4 of the drawings where the handle angle and its height are optimized with respect to the water reservoir tank shape, in order to balance the water weight over the spaced wheels 53, 53, when moving the water reservoir tank to and from a water source. In the FIGS. 1–4 embodiment, a foot rest 71 is mounted or formed relative to the water reservoir tank 45 between the spaced wheels 53, 53 as illustrated in FIGS. 2–3 of the drawings. As indicated above, the foot rest 71 is exposed when the decorative lower front molding 49 is raised. The foot rest 71 enables a user to tilt the water reservoir tank 45 on the spaced wheels 53, 53 for moving the water reservoir tank to and from a water source.

The tilting of the water reservoir tank 45 also enables the lower guide end portions or legs 55, 55 to be displaced relative to the U-shaped openings 13, 13 formed in the supporting base 3, at opposite sides thereof. Prior to such tilting, the lower guide portions or legs 55, 55 cooperate with the U-shaped recesses 13, 13 at opposite ends of the supporting base 3 for detachably mounting the water reservoir tank 45 relative to the supporting base 3 and the fixed compartment 5. When a user places a foot against the foot rest 71; however, the water reservoir tank 45 is tilted, and this causes the lower guide portions or legs 55, 55 to be moved outside of the spaced U-shaped openings 13, 13, in order to permit the water reservoir tank 45 to be moved to a water source for filling. Upon return to the floor mounted humidifier 1, a user will re-position the water reservoir tank 45 such that the lower guide portions or legs 55, 55 are re-positioned relative to the spaced U-shaped openings 13, 13 at opposite ends of the supporting base 3.

After detaching the water reservoir tank 45 relative to the supporting base 3 and fixed compartment 5, the water reservoir tank 45 is now capable of being moved to a water source, as shown in FIG. 3 of the drawings. The water reservoir tank 45 is shown as including a connecting hose 73 having a hose fitting 75 which is constructed to be readily mounted over the faucet F, as illustrated in FIG. 3. In its non-operative condition, the hose 73 is contained within the water reservoir tank 45 while the hose fitting 75 is also capable of being slidably mounted relative to a fill opening 77 that is contained within an enlarged recess 79 in the upper end 69 of the water reservoir tank 45. It will be noted that the fitting 77 includes an enlarged flange 81 that is larger than the fill opening 77 in order to support the hose fitting 75 and the connecting hose 73 within the water reservoir tank 45, as illustrated in FIG. 4 of the drawings.

In lieu of filling the water reservoir tank through the connecting hose 73 and hose fitting 75 as described above, the enlarged recess 79 is constructed to enable a user to pour water from a separate container (not shown) into the recess opening 79 for entry into the hose fitting 75 and connecting hose 73, in order to fill the water reservoir tank 45.

For filling the catch basin 11, the water reservoir tank 45 includes a water dispensing valve 83 mounted relative to a lower end surface of the water reservoir tank 45, for selectively dispensing water into the catch basin 11. The water dispensing valve 83 is constructed to dispense a predetermined amount of water only into the catch basin 11 as needed by the wicking element 25. To prevent an excess of water being dispensed, the catch basin 11 includes an overflow valve mechanism 85, the operation of which is best shown in FIG. 8.

At the lower end of the water reservoir tank 45, the water dispensing valve 83 is shown as including a valve stem 87 that is slidably mounted within a corresponding opening 89 in a central wall 91 of the closure 93. Closure 93 is threadably mounted to an externally threaded depending circumferential wall 95 that extends from the water reservoir tank. An O-ring 97 is captured between the closure 93 and the depending circular wall 95, as illustrated.

At the upper end of the stem 87, a frusto-connically shaped valve seat/seal 99 is mounted for cooperative seat/seal engagement with upper outermost areas of the closure circumferential wall 101, as represented by the dotted line position of the valve seat/seal 99. In its upper full line position, the valve seat/seal 99 allows water to drain from the water reservoir tank 45 through openings (not shown) in the central wall 91 and into the catch basin 11 of the supporting base 3.

The overflow valve 85 works in conjunction with the water dispensing valve 83 to shut off the water dispensing valve 83 when the water level in the supporting base 3 rises beyond a predetermined level. Below the predetermined level, the overflow valve 83 is suspended in a neutral position, allowing the water dispensing valve 83 to selectively dispense water to the predetermined level. Should this level be exceeded, the overflow valve 85 will suspend the operation of the water dispensing valve 83.

For this purpose, the overflow valve 85 is pivotally mounted at 101 to the supporting base 3 and includes a float 103 at one end and an operative arm 105 at opposite end which engages the lower end of the stem 87 of the water dispensing valve 83. The float 103 is constructed for movement about the pivot point 101 within the complementary shaped depression 107 formed in the supporting base 3. The float 103 is designed to suspend the overflow valve 85 in a neutral position when the water level is at a normal or predetermined level. As the water level rises, the float 103 will lift and this will cause the operative arm 105 to lower, from the full to the phantom line illustration shown in FIG. 8, allowing the spring 109 surrounding the valve stem 87 to move the valve seat/seal 99 into seated/sealed relationship relative to the upper end portions of the circumferential closure wall 101. The reverse takes place when the water level is below a predetermined point. Specifically, the operative arm 105 of the overflow valve 85 is moved from the phantom to the full line position shown in FIG. 8 where the coil spring 109 surrounding the valve step 87 is depressed, causing the valve seat/seal 99 to be moved from the dotted to the full line position where water can be selectively dispensed from the water reservoir tank 45 into the catch basin 11 of the supporting base 3.

The aforementioned combined water dispensing valve 83 and overflow valve 85 is required in a water reservoir tank 45 which has both a lower water dispensing opening as well as an upper water filling opening. If the upper water filling opening is not sealed, no vacuum will form inside the reservoir tank, and an excess of water will be dispensed through the water dispensing valve 83 bringing into operation the overflow valve 85. It is thus unlike the typical water feeder valves associated with prior art refillable containers.

Reference is now made to the alternative embodiment depicted in FIGS. 5–7 which is the preferred construction for the floor mounted humidifier of the present invention. Corresponding reference numerals will be used to identify like parts with the prefix "100" series used in the FIGS. 5–7 embodiment to distinguish from the FIGS. 1–4 embodiment. The floor mounted humidifier with wheeled water reservoir tank 101 in the FIGS. 5–7 embodiment includes a supporting base 103, a fixed compartment 105 mounted on the supporting base 103 which also incorporates the humidifying system previously described, and the wheeled water reservoir tank 107 which is positioned adjacent to and detachably mounted relative to the fixed compartment 105 and mounted relative to the supporting base 103.

The fixed compartment 105 includes lower and upper upstanding and stacked rectangularly shaped injection molded components 116, 118, respectively, that are constructed in the same manner as in the FIGS. 1–4 embodiment. Within the lower and upper molded components 116 and 118 of the fixed compartment 105, the humidifying system contains components that are similar to those illustrated in the FIGS. 1–4 embodiment.

On the other hand, the supporting base 103 and the water reservoir tank 107 are constructed differently than in the FIGS. 1–4 embodiment, as will become apparent. Because there is no upwardly movable lower front molding in the floor mounted humidifier 101 as in the FIGS. 1–4 embodiment, the decorative molded cover elements 146, 146 illustrated in FIG. 5 and shown as being mounted to the front and end surfaces of the water reservoir tank 145 are specifically different. As a result, the supporting base 103 and a detachable compartment 107 are different, as well. More specifically, it will be noted that each of the decorative molded cover elements 146 include a decorative front side molding 147 and an integral decorative end molding 148. At the lower end of the decorative front side molding 147, there is provided an angularly outwardly directed foot rest 150 which is integrally connected to a lower portion 152 of the decorative end molding 148. The lower end portion 152 has a general L-shape, the integral foot 158 of which is adapted to complementary mate with a recessed area 160 of the corresponding portion 154 in the supporting base 103, as best seen in FIGS. 5 and 6. It will be appreciated that the complementary and interengaged L-shaped portions 152, 154 provide a complementary and interengaged fit between the detachable compartment 107 and the supporting base 103, while achieving an overall decorative look and appearance simulating a one-piece unit, when the detachable compartment 107 is mounted relative to the supporting base 103, as illustrated in FIG. 5 of the drawings.

It will be noted that each of the outwardly angularly shaped portions 150 of the decorative front side moldings 147 are complementary mated with respect to an elongated similarly constructed outwardly angularly shaped element 156 that extends between the spaced outwardly angularly shaped portions 150, 150 of the decorative front side moldings 147, 147, as also best seen in FIG. 5. Thus, a lower, non-movable front molding 156 is attached to the water reservoir tank 145 between the spaced outwardly angularly shaped portions 150, 150 to provide a general overall decorative look for the floor mounted humidifier 101 at the lower end of the water reservoir tank 145. It will also be noted that the outwardly angularly shaped spaced portions 150, 150, together with the similarly constructed elongated element 156, provides a foot rest for tilting the water reservoir tank 145, in a manner similar to the FIGS. 1–4 embodiment, except that the FIGS. 5–7 embodiment does not require the decorative lower front molding composed of the elongated element 156 and the spaced portions 150, 150 to be raised upwardly. This avoids an extra step by the user when it is desired to detachably remove the water reservoir tank 145 relative to the supporting base 103 and the fixed compartment 105.

There are several additional differences of the floor mounted humidifier 101 as shown in the FIGS. 5–7 embodiment. FIG. 6 of the drawings is an exploded fragmentary perspective view illustrating the manner in which the detachable compartment 107, including the water reservior tank 145, is detachably mounted relative to the supporting base 103. For this purpose, each of the decorative molded cover elements 146, at opposite ends of the water reservoir tank 145, have a depending foot element 158 which is configured and dimensioned for complementary mating engagement with a complementary shaped recess 160 provided in the supporting base 103. Thus, in mounting the detachable compartment 107 and its associated water reservoir tank 1 relative to the supporting base 103, a user will engage a part of the foot rest area 150, 150 and 156 at the lower end of the water reservoir tank 145 for tilting same relative to the supporting base, in order to conveniently move the depending integral foot elements 158, 158, on opposite sides of the detachable compartment 107, into the corresponding complementary shaped recesses 160, 160 at opposite ends of the supporting base 103. The reverse procedure is followed in separating the detachable compartment 107 from the supporting base 103, as will be appreciated.

The decorative molded cover element 146 also includes a modified inside configuration for receiving the spaced and opposed handle side legs 163, 163 of the U-shaped handle 167 in the FIGS. 5–7 embodiment. Specifically, as best seen in FIG. 7 of the drawings, each decorative molded cover element 146 includes, on an internal wall of the decorative end molding 148, an integrally formed and angularly offset U-shaped channel 162 which replaces the tube guides 57 in the FIGS. 1–4 embodiment. Specifically, each U-shaped channel 162 is constructed to receive the spaced and opposed handle side legs 163, 163 of the telescoping/retractable U-shaped handle 157 in the FIGS. 5–7 embodiment. When mounted within the U-shaped integral angularly offset channel 162, the lower end of each handle side leg 163 may extend within or be spaced upwardly from the integral foot element 158, as may be desired. As will be appreciated, there is no need for the tube guides to serve also as legs, as in the FIGS. 1–4 embodiment, since the decorative molded cover elements 146 each are provided with integral foot elements 158 which function in the manner described above.

The preferred construction of the floor mounted humidifier of the present invention is preferably of the type illustrated in FIGS. 5–7 of the drawings, although many of the internal components of the humidifier will be the same as previously described and illustrated in connection with the FIGS. 1–4 embodiment. Manufacturers can, of course, choose whichever embodiment they prefer or may design other and different embodiments not specifically disclosed and illustrated, but which would nevertheless incorporate the essential novel and inventive features of the present invention.

From the foregoing, it will now be appreciated that the floor mounted humidifier with wheeled water reservoir tank 1 provides floor movement of the water reservoir tank from the humidifier to a water source to fill the water reservoir tank and for return to the floor mounted humidifier. A handle, preferably of the retracting/telescoping variety, is mounted to the water reservoir tank, for extension to facilitate wheeled movement of the water reservoir tank to a water source for filling same and for return to the floor mounted humidifier. The handle can then be retracted to a non-operative position when the wheel mounted water reservoir tank is subsequently re-positioned relative to the humidifier. Preferably, the water reservoir tank is detachably mounted to the humidifier, although it is contemplated that other arrangements such as adjacent positioning or mounting relative to the humidifier or humidifying system is also possible. To facilitate filling of the water reservoir tank, a connecting hose with a hose fitting that also functions as a restrictive element relative to the fill opening, enables the connecting hose to be positioned within the water reservoir tank, until a user grasps the hose fitting for mounting to a faucet. A larger recessed opening surrounding the fill opening permits filling of the water reservoir tank by a separate container, as well. A unique water dispensing valve and overflow valve regulate the dispensing of water, as desired.

Numerous other features and advantages as discussed above enables the floor mounted humidifier with wheeled water reservoir tank to provide a safe, reliable and efficient method of filling a water reservoir tank which is detachably or otherwise associated in adjacently positioned relationship to a floor mounted humidifier.

In view of the above, it will be seen that the several objects and the advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

We claim:

1. In a floor mounted humidifier including humidifying means for drawing air into and for discharging humidified air from the humidifier, the improvement comprising: a water reservoir tank positioned adjacent said humidifying means, said water reservoir tank being mounted on wheels and including a telescoping handle that is extended in order to facilitate wheeled movement of the water reservoir tank to a water source for filling of the water reservoir tank and for return to the floor mounted humidifier, said telescoping handle being a U-shaped handle having opposing handle side legs interconnected to a handle end leg, the opposing handle side legs being mounted over opposite end surfaces of the water reservoir tank to present the handle end leg in a generally horizontal position for gripping by a user.

2. The improvement as defined in claim 1 wherein the opposing handle side legs of the U-shaped handle are mounted in angularly offset guide elements attached to opposite end surfaces of the water reservoir tank to present the opposing handle side legs and handle end leg of the U-shaped handle at an angle to a top surface of the water reservoir tank when the U-shaped handle is extended.

3. The improvement as defined in claim 2 wherein the water reservoir tank includes depending leg portions for complementary reception within complementary recesses in a supporting base of the humidifier.

4. The improvement as defined in claim 2 wherein the angular offset guide elements include guide portions that extend below the water reservoir tank to serve as legs in supporting the water reservoir tank in an upright position in conjunction with the wheels.

5. The improvement as defined in claim 4 wherein the guide portions that extend below the water reservoir tank are also cooperatively received within complementary recesses of the humidifier for detachably mounting the water reservoir tank to the humidifier.

6. A floor mounted humidifier including:

a supporting base;

a fixed compartment and a detachable compartment mounted relative to the supporting base and to each other;

the fixed compartment containing humidifying means for drawing dry air into and for discharging humidified air from the humidifier;

the detachable compartment being detachably mounted relative to the supporting base and fixed compartment and including a water reservoir tank mounted on wheels for movement to a source of water supply to facilitate filling of the water reservoir tank and return to the humidifier; and a telescoping handle that is capable of extending for movement of the water reservoir tank and also capable of collapsing to an out-of-the-way position when the detachable compartment is detachably mounted relative to the supporting base fixed compartment, said telescoping handle being a U-shaped handle having opposing handle side legs and an interconnected handle end leg, the opposing handle side legs being mounted over opposite end surfaces of the water reservoir tank.

7. The floor mounted humidifier as defined in claim 6 wherein the U-shaped handle is capable of being extended at an angle to an upper horizontal surface of the water reservoir tank.

8. The floor mounted humidifier as defined in claim 6 wherein the opposing handle side legs of the U-shaped handle are received within tube guides mounted relative to each opposing end surfaces, each tube guide including tube guide portions that extend below the water reservoir tank in an upright position and each serving as leg for supporting the water reservoir tank in an upright position in conjunction with said wheels.

9. The floor mounted humidifier as defined in claim 6 and including a hinged cover mounted to the fixed compartment for overlying the detachable compartment when detachable mounted to the supporting base.

10. The floor mounted humidifier as defined in claim 6 wherein the wheels are mounted at opposite ends of the water reservoir tank along one side only, and a foot rest is positioned intermediate the wheels to facilitate tilting and separation of the detachable water reservoir compartment including water reservoir tank for filling.

11. The floor mounted humidifier as defined in claim 6 wherein the opposing handle side legs of the U-shaped handle are received slidably within channels formed in decorative molded cover elements mounted to opposite end surfaces of said water reservoir tank.

12. The floor mounted humidifier as defined in claim 11 wherein the decorative molded cover elements include depending foot elements for complementary reception within recesses formed in the supporting base for detachably mounting the detachable compartment relative to the supporting base.

13. The floor mounted humidifier as defined in claim 11 and including a dispensing valve and associated overflow valve mounted relative to a lower end surface of the water reservoir tank for selectively dispensing water to the humidifying means.

14. The floor mounted humidifier as defined in claim 6 wherein the water reservoir tank includes a connecting hose for attachment to a water faucet to facilitate filling of the water reservoir tank.

15. The floor mounted humidifier as defined in claim 14 wherein the connecting hose is received within the water reservoir tank when not in use.

16. The floor mounted humidifier as defined in claim 15 wherein an upper end of the connecting hose includes a hose fitting that both connects to a water faucet while also being slidably mounted relative to an fill opening in an upper end of the water reservoir tank.

17. The floor mounted humidifier as defined in claim 16 and further including an enlarged recess in an upper end of the water reservoir tank surrounding the fill opening to enable filling of the water reservoir tank by hand pouring of water from a separate container.

* * * * *